US005165315A

United States Patent [19]

Terada

[11] Patent Number: 5,165,315

[45] Date of Patent: Nov. 24, 1992

[54] KEY DUPLICATING MACHINE

[76] Inventor: Masaji Terada, 15-15-202, Higagari 2-chome, Kokurakita-ku, Kitakyushu-shi, Fukuoka 803, Japan

[21] Appl. No.: 757,147

[22] Filed: Sep. 10, 1991

[30] Foreign Application Priority Data

Sep. 10, 1990 [JP] Japan ..... 2-240403

[51] Int. Cl.[5] ..... B26F 1/12

[52] U.S. Cl. ..... 83/413; 83/36; 83/249; 83/917; 269/56

[58] Field of Search ..... 83/411.7, 413, 414, 83/464, 692, 917, 35, 36, 249, 412; 269/56

[56] References Cited

U.S. PATENT DOCUMENTS

| | | | |
|---|---|---|---|
| 894,726 | 7/1908 | Corbin | 83/917 X |
| 2,812,816 | 11/1957 | Hoffman | 83/917 X |
| 3,748,940 | 7/1973 | Muri | 83/414 |
| 3,769,865 | 11/1973 | Kleist | 83/917 X |
| 4,373,414 | 2/1983 | Agius | 83/917 X |
| 4,651,604 | 3/1987 | Almblad et al. | 83/917 X |

*Primary Examiner*—Frank T. Yost
*Assistant Examiner*—Clark F. Dexter
*Attorney, Agent, or Firm*—Armstrong & Kubovcik

[57] ABSTRACT

A device to duplicate a key utilizing the predetermined pitch codes and depth codes of the key to be duplicated, wherein a punch which produces an individual pattern of serrations and a die which makes a pair with said punch are used, a key-holding means which clamps a blank key to be duplicated is moved to the specified position by the use of a pitch code plate and either a depth code plate provided with stair-like codes corresponding respectively to the depth code of the key to be duplicated or a depth code piece whose contacting faces have the width corresponding respectively to the depth code of the key to be duplicated and, by the use of aforesaid punch and die, an individual serration pattern is formed one by one on the blank key mounted on the device.

4 Claims, 5 Drawing Sheets

Fig.3
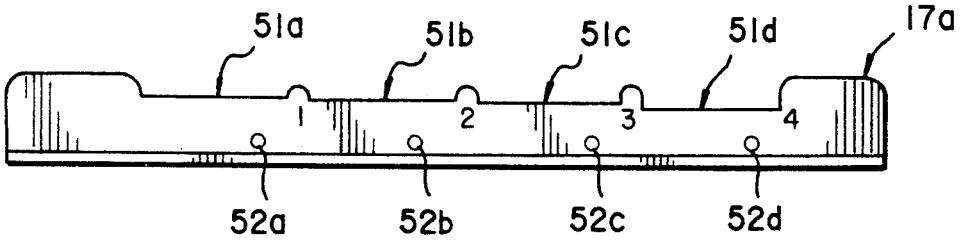
Fig.4
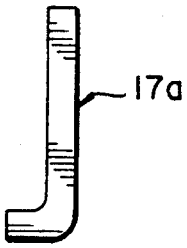
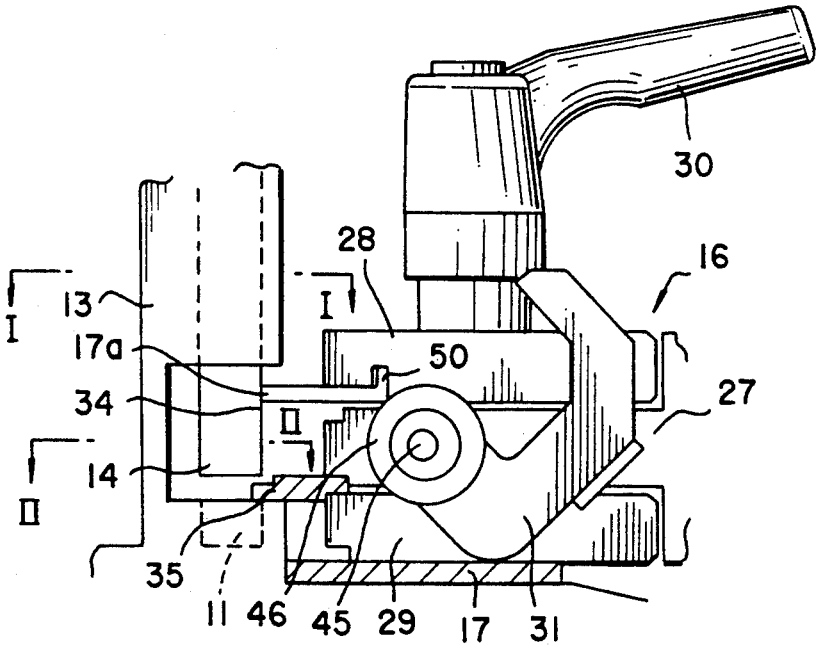
Fig.5

Fig.13
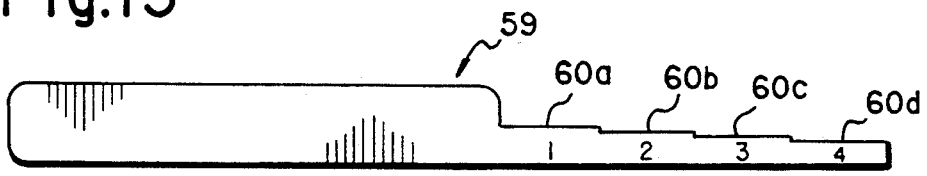
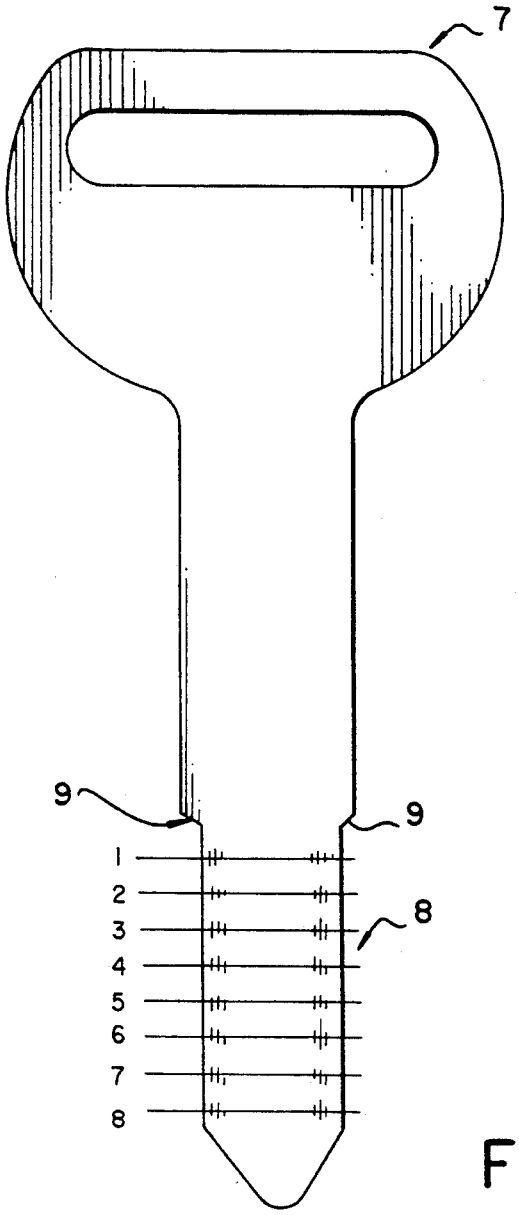
Fig.14
PRIOR ART

KEY DUPLICATING MACHINE

BACKGROUND OF THE INVENTION

The present invention relates to a key duplicating machine which duplicates a key by utilizing the key codes through a pressing process by use of a punch and a die into which said punch is inserted.

The serrated portion of an ordinary genuine key is made up with cuts having particular depths and formed in a specified pitch, with the shoulder portions being the datum.

These cuts are formed based on the predetermined pitch codes (1 through 8, for example) and the predetermined depth codes (1 through 4, for example), and the key is provided with the code symbols indicating those codes. Therefore, by providing shoulder portions 9 which becomes the datum of pitch on the portion 8 to be serrated of a blank key 7 and by providing serrations which correspond to aforesaid code symbols, with said shoulder portions 9 being the datum as shown in FIG. 14, it becomes possible to duplicate a key.

And, the key duplicating machine used for such a purpose consisted of a key-holding means to support said key, a rotary cutter, and a feeding device to move aforesaid key-holding means longitudinally and transversely on the machine by the predetermined pitch.

However, on the conventional key duplicating machine, there has been a problem that it becomes large in total size as a device and is inconvenient to carry because it is provided with a motor, etc. for driving a cutter.

SUMMARY OF THE INVENTION

The present invention has been made in view of above-mentioned circumstances and, accordingly, it is an object of this invention to provide a key duplicating machine utilizing the key codes of a genuine key, which is easy to carry, able to be compact, and is possible to manufacture in a low cost.

The key duplicating machine relating to the first embodiment of the invention with the above-mentioned object comprises a punch which produces an individual pattern of serrations, a die which makes a pair with said punch, a driving means which drives aforesaid punch, a key-holding means which clamps a blank key to be duplicated and can move the key at least longitudinally and transversely in relation to the duplicating machine frame, a pitch code plate into which a code-groove-detecting portion disposed on the bottom of aforesaid key-holding means is inserted and on which a specified number of parallel grooves are formed corresponding respectively to the pitch code of the key to be duplicated, and a depth code plate which is attached to aforesaid key-holding means so as to move transversely, and which is contacted in use to aforesaid punch, die, or a supporting metal fitting thereof, and is provided with plural stair-like codes corresponding respectively to the depth codes of the key to be duplicated.

In the case of a key duplicating machine relating to above-mentioned first embodiment, a blank key is clamped to the key-holding means by adjusting the datum shoulder portion on either one side of the blank key to the specified position of the key-holding means.

First, the pitch code is detected by inserting the code-groove-detecting portion which is disposed on the bottom of the key-holding means into the specified groove of the pitch code plate. Then, by reading the depth of the depth code corresponding to each pitch from the code symbols, by adjusting the depth code plate attached to the key-holding means so as to move transversely to the punch to set the specified depth, and by contacting said depth code plate to aforesaid punch, die, or the supporting metal fitting thereof, the portion to be cut by the punch is determined. And then, by operating the driving means so as to lower the punch, by forming one serration at the specified position on the blank key, by forming serrations to the other portions, by moving the key-holding means along aforesaid parallel grooves, and by moving the depth code plate so as to select the corresponding depth code, serrations are formed on one side of the blank key.

Second, the blank key is removed from the key-holding means and, through the same processes as described above, serrations are formed on the other side of the blank key, that is, a key is duplicated by a simple device.

Then, the key duplicating machine relating to the second embodiment of invention with the above-mentioned object comprises a punch which produces an individual pattern of serrations, a die which makes a pair with said punch, a driving means which drives aforesaid punch, a key-holding means which clamps a blank key to be duplicated and can move at least longitudinally and transversely on the machine frame, a pitch code plate into which a code-groove-detecting portion disposed on the bottom of aforesaid key-holding means is inserted and on which the specified number of parallel grooves are formed corresponding respectively to the pitch code of the key to be duplicated, and a depth code piece which is disposed between aforesaid key-holding means and aforesaid punch, die, or the supporting metal fitting thereof and whose contacting faces have a width corresponding respectively to the depth code of the key to be duplicated.

In the case of key duplicating machine relating to the second embodiment, the processes to duplicate a key are nearly the same as those of key duplicating machine relating to above-mentioned first embodiment, except that the depth of a serration is determined by moving said depth code piece right and left because, in this case, a depth code piece whose contacting faces have a width corresponding to the depth code of the key to be duplicated is used in place of the code plate used in the case of key duplicating machine relating to above-mentioned first embodiment.

Therefore, by use of the key duplicating machine relating to the first and second embodiments described above, a key whose pitch codes and depth codes are known can be duplicated by a device that is easy to carry, able to be compact, and is possible to manufacture in a low cost.

BRIEF DESCRIPTION OF THE DRAWINGS

FIG. 3 is a plan view of a depth code plate used in said key duplicating machine, FIG. 4 is a side view of the same, FIG. 5 is a partial side view of said key duplicating machine, FIG. 13 is a plan view of a depth code piece used in the second embodiment, and FIG. 14 is a plan view of a key relating to the conventional embodiment.

DESCRIPTION OF PREFERRED EMBODIMENT

Figure 1:
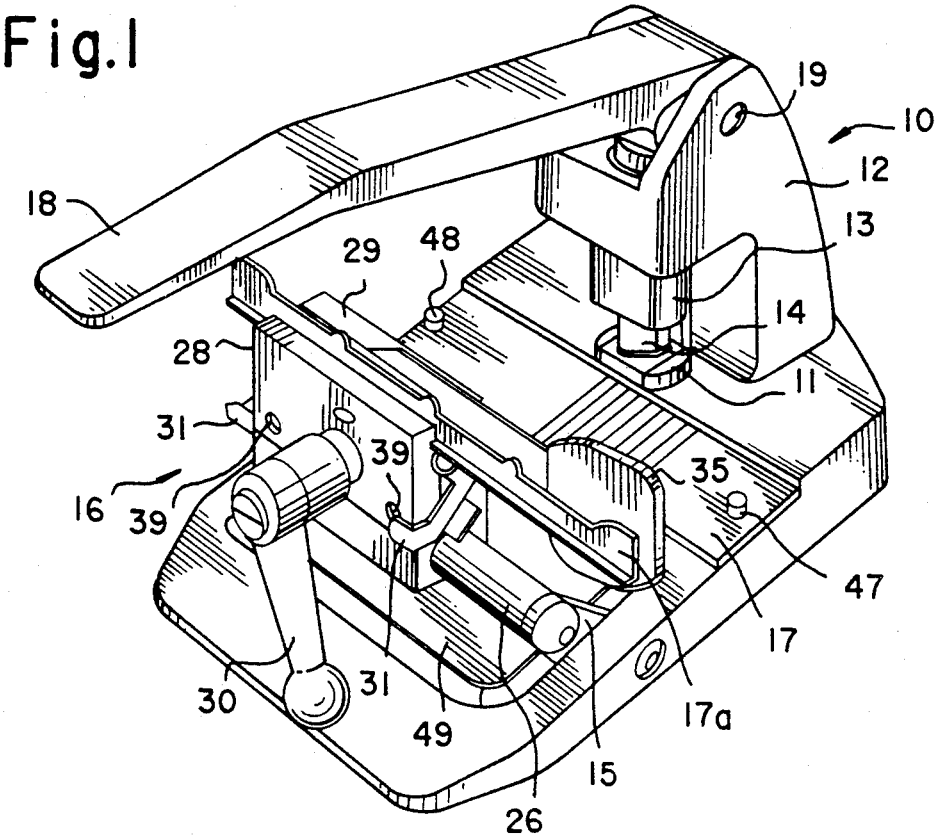
FIG. 1 and FIG. 2 are perspective views of a key duplicating machine relating to one embodiment of this invention.
Figure 2:
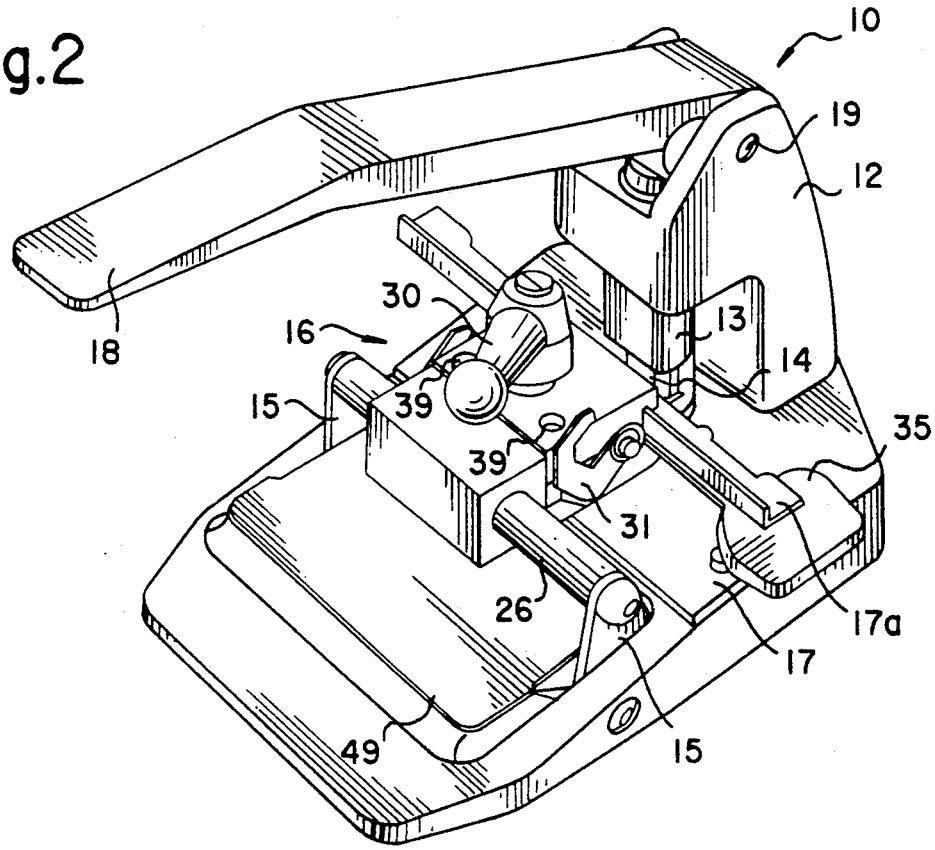
Figure 12:
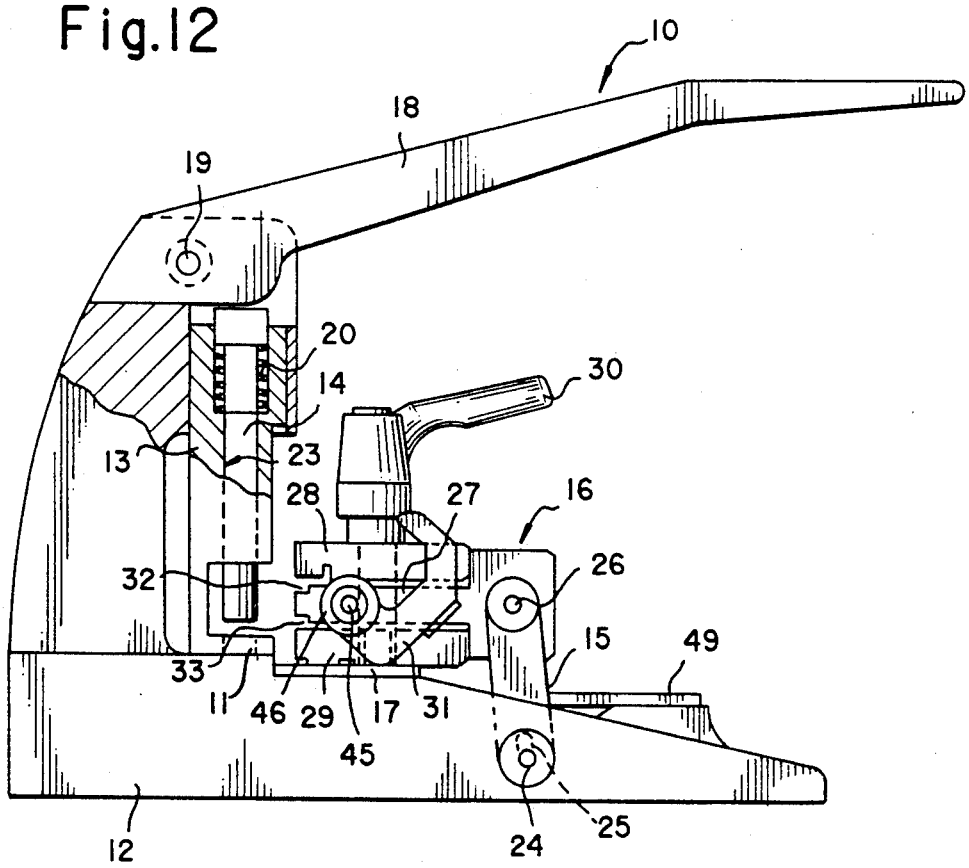
FIG. 12 is a side view, with a portion cut away, of said key duplicating machine.

As shown in FIGS. 1 and 2, and FIG. 12, the key duplicating machine 10 relating to one embodiment of this invention comprises a frame 12 having a base portion and a vertical member which has nearly C-shaped side faces and to which base portion a die 11 is fixed, a guide member 13 which is fixed to the vertical member of frame 12 integrated with aforesaid die 11, a punch 14 which is installed via said guide member 13, right and left supporting arms 15 which are attached to aforesaid frame 12 in such a manner as to rotate on an axis and move in a radial direction, a key-holding means 16 which is rotatably installed at the top portion of said supporting arms 15, a pitch code plate 17 which is attached onto aforesaid frame 12 and used also as height-adjusting plate, and a depth code plate 17*a* which is installed at the top portion of aforesaid key-holding means 16 in such a manner as to move laterally with respect to punch guide member 13. The details of these components will be explained hereinbelow.

Aforesaid frame 12 is made of die-cast aluminum, zinc, etc., or made of cast iron or cast steel and, on the top of the vertical member thereof, a manual pressing lever 18 is rotatably attached via a pin 19, and guide member 13 in which punch 14 is slidably provided is disposed vertically beneath the pressing lever. On the top end of said punch 14, aforesaid manual pressing lever 18 is contacted as shown in FIG. 12 and, further, the head portion of said punch 14 has a circular section and is provided, at the inside thereof, with a spring 20 which presses said punch 14 upwards.

In addition, in this embodiment, though aforesaid guide member 13 and the die 11 disposed therebelow are made into one piece so that the respective pressing center lines may coincide with each other without fail, it is possible to separate the guide member 13 and the die 11.

Figure 7:
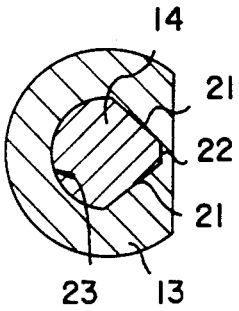
FIG. 7 is a sectional view along line I—I of FIG. 5.
Figure 8:
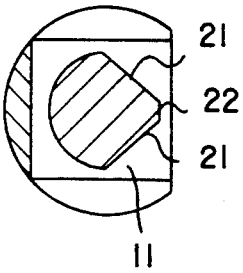
FIG. 8 is a sectional view along line II—II of FIG. 5.

The cutting portion 21 of aforesaid punch 14 has a section with side faces at a 70° to 120° (approx. 90° is preferable) angle as shown in FIGS. 7 and 8, and has a small flat (replaceable with a circle having a large curvature) portion 22 in the front face and, in aforesaid guide member 13, a sliding hole 23 is formed so that the punch 14 having such a shape may move up and down without rotating.

Figure 6:
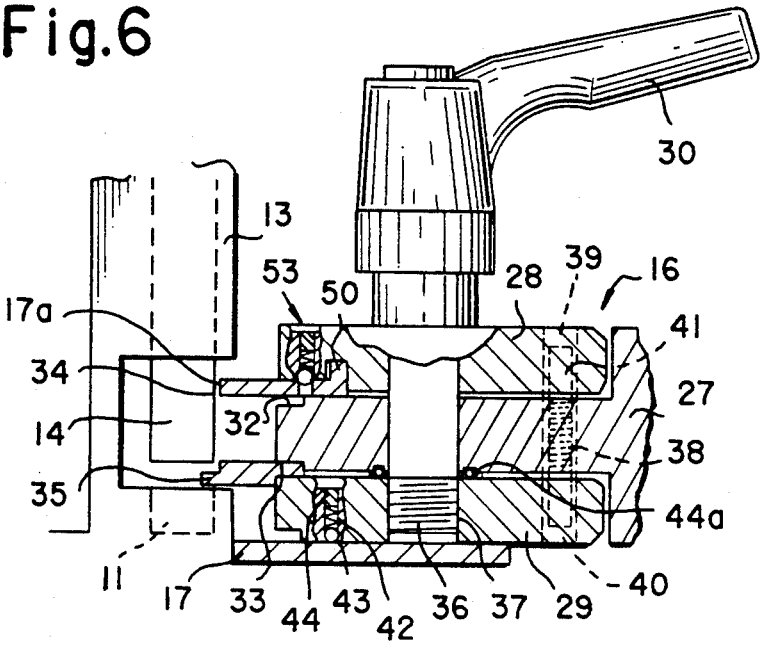
FIG. 6 is a sectional side view of the same.

To both sides of aforesaid frame 12, there is respectively attached a supporting arm 15 made of a metal plate via pin 24 as shown in FIG. 12. The attaching portion of each supporting arm 15 forms a slot hole 25 so that said supporting arm 15 may move back and forth in a radial direction about pin 24. To the top portion of aforesaid supporting arms 15, a supporting shaft 26 is attached and, to this supporting shaft 26, a key-holding means 16 is so attached so as to rotate about the shaft and to slidably move transversely to the frame 12, constructing a mechanism to allow the key-holding means 16 to move right and left and to and fro. In addition, the depth code plate 17*a* is omitted in FIG. 12. As shown in FIGS. 5 and 6, said key-holding means 16 comprises a central fixing member 27, an upper plate 28 and a lower plate 29 which are attached to said fixing member 27, a fastening lever 30 which fastens said upper plate 28 and lower plate 29 to aforesaid fixing member 27 at the same time, and a pair of latches 31 which are respectively attached rotatably to both sides of aforesaid fixing member 27.

The front portion of aforesaid fixing member 27 is made thin by the cutaway portions 32 and 33 provided on the top and bottom faces thereof so that an original key to be copied (not shown) may be clamped at the top portion, and either side of two thinned portions of the blank key 35 may be clamped at the bottom portion in the case where aforesaid depth code plate 17*a* is not used, and the lower plate 29 is provided with a female screw 37 which is mated with a male fastening screw thread 36 of aforesaid fastening lever 30. And, female screws 38 are provided respectively at both right and left sides of aforesaid fixing member 27 and, into said female screws 38, guide rods 41 respectively passing freely through guide holes 39 and 40 formed at both sides of upper plate 28 and lower plate 29 are screwed.

In addition, it is possible to fix said guide rods to the fixing member by press fit without using screws. And, as shown in detail in FIG. 11, the lower plate 29 is provided with a movable projection 43 consisting of a spring 42, a ball 42*a* which is pressed by said spring 42, and a screwed member 44 for setting them, and the ball 42*a* at the bottom is so designed as to the contact above-mentioned pitch code plate 17. In addition, this movable projection 43 constitutes a code-groove-detecting portion in this embodiment.

Figure 11:
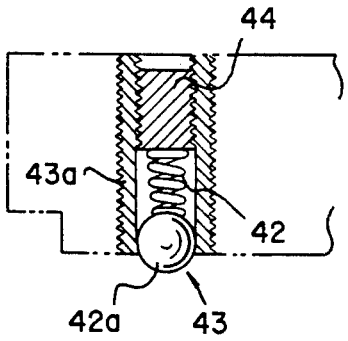
FIG. 11 is a sectional view of a code-groove-detecting portion of said key duplicating machine.

In FIG. 11, the number 43*a* shows a screwed cylinder, the number 44 shows a set screw and, in FIG. 6, the number 44*a* shows an O-ring (replaceable with a spring) which is one example of elastic substances.

At both sides of aforesaid fixing member 27, a latch 31 is respectively and rotatably provided via a pin 45 and a seat plate 46, so as to engage a blank key 35 inserted from either side. The axial position of the blank key 35 is determined by mounting the blank key 35 onto said key-holding means 16 so that said latch 31 may contact the shoulder portions 9 of a blank key 35.

At both sides of aforesaid frame 12, projecting pins 47 and 48 are provided so that the pitch code plate 17 may be detachably mounted via them. On the top portion of the frame 12 where the supporting arms 15 are attached, a rubber plate 49 is disposed so that said key-holding means 16 may be mounted without flaw, etc.

The top portion of upper plate 28 of aforesaid key-holding means 16 is formed into L-shape by a groove 50 provided transversely of plate 28 as a guide so that the above-mentioned depth code plate 17*a* may be inserted therein, and said depth code plate 17*a*, as shown in FIGS. 3 and 4, is made of an L-shaped metal provided with contacting faces 51*a* through 51*d* each of which has a width corresponding to each depth code of the key (four steps corresponding respectively to the codes 1 through 4 in this embodiment) and contacts a flat portion 22 of the punch 14. Plate 17*a* is also provided with four positioning holes 52*a* through 52*d* so that a ball disposed at the bottom end of movable projection 53 which is attached to said upper plate 28, shown in FIG. 6, and whose construction is the same as that of aforesaid movable projection 43 may be inserted therein so as to determine the position in the transverse direction of said depth code plate 17*a*.

In this embodiment, in addition, the depth code plate 17*a* is made of an L-shaped metal and its L-shaped bent portion is used as a guide which is inserted into above-said groove 50. It is, however, possible to form said depth code plate 17*a* into a flat plate and to provide a linear groove (V-shape groove, for example) or a linear projection to said flat plate as a guide so that said depth code plate may move parallel to the mounted blank key by forming, on above-mentioned upper plate, a linear projection which inserts into said groove or a linear groove which receives said linear projection. Further this invention is applied to the embodiment wherein the depth code plate is a simple flat plate.

Figure 9:
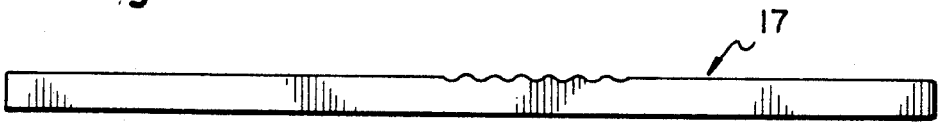
FIG. 9 is a front view of a pitch code plate used in said key duplicating machine.
Figure 10:
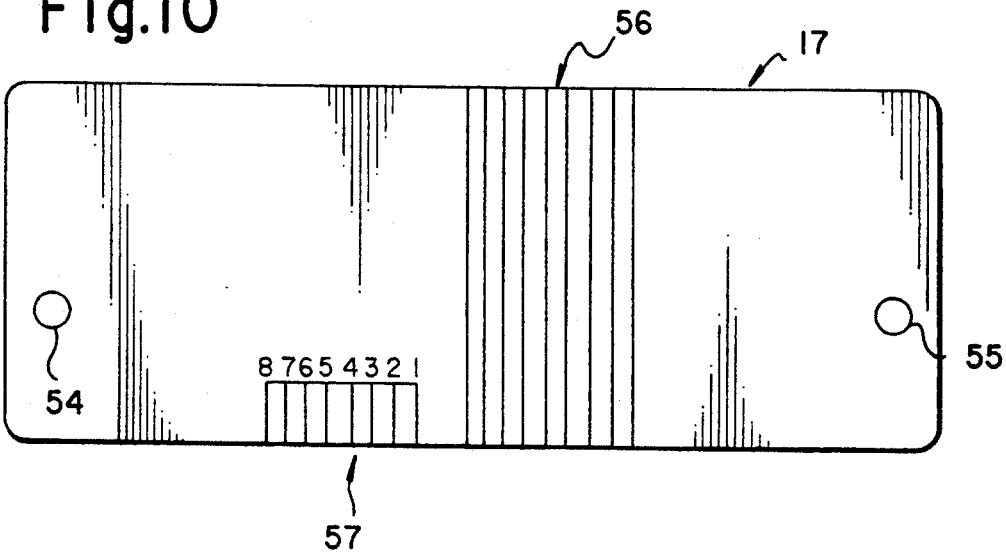
FIG. 10 is a plan view of the same.

As shown in FIGS. 9 and 10, aforesaid pitch code plate 17 is made of a piece of light metal plate, both sides of which are provided with holes 54 and 55 into which aforesaid pins 47 and 48 are inserted respectively and, at the specified position in the center portion of the plate, there are formed parallel grooves 56 with a pitch corresponding to the pitch code of the key. The number 57 shows a scale and, by reading the end position of key-holding means 16 mounted thereon from said scale 57, the pitch code position of said key-holding means 16 can be read. It is also possible to dispose a proper adjusting plate under this pitch code plate 17 so as to adjust the height of blank key 35 to that of die 11.

Accordingly, in case of using this key duplicating machine 10, the key-holding means 16 is first rotated on supporting shaft 26 and put on aforesaid rubber plate 49 as shown in FIG. 1, then the fastening lever 30 is loosened to loosen the upper plate 28 and the lower plate 29 which are attached to the fixing member 27. Then the depth code plate 17*a* corresponding to the depth code of the key to be duplicated is mounted between the upper plate 28 and the fixing member 27, and the pitch code plate 17 corresponding to the pitch code of the key to be duplicated is mounted via the pins 47 and 48. Then, the blank key 35 is placed between the lower plate 29 and the fixing member 27 as shown in FIG. 5 by and aligned pressing forward the latch 31 to make it meet the shoulder portions 9 of the key (also called a starting pitch), and the blank key 35 is secured to said key-holding means 16 by turning the fastening lever 30 a little.

And then, the key-holding means 16 is rotated on shaft 26 and pressed forward as shown in FIG. 2 so that the top end of blank key 35 may be put on the die 11. In this case, because the height (thickness) of keys varies depending on the kind of key, an adjusting plate having a proper height (thickness) is placed under the pitch code plate 17 so that the blade portion of the key to be duplicated may be put on the top end of the die 11.

After the processes described above, corresponding to the key, code when the key-holding means is rotated as described above the moveable projection 43 provided on the bottom portion of the key-holding means 16 is first inserted into the first groove of the parallel grooves 56 and, with the movable projection 43 being inserted, the depth code plate 17*a* is moved transversely to select the specified depth code and, with a selected one of the contacting faces 51*a* through 51*d* of said depth code plate 17*a* contacting the flat portion 22 of the punch 14, one serration is formed on the blank key 35 by one pressing action of the punch 14 caused by the manual pressing lever 18 pressed by one hand while holding tight said key-holding means 16 by the other hand. Then, the contacting face which corresponds to the depth code is selected from the depth code plate 17*a* while moving said key-holding means 16 transversely along the rotating shaft 26 pitch by pitch and, by forming the serration pattern corresponding to all the serrations on the blank key 35, serrations are duplicated on one side of the key to be duplicated, and then, to the other side, the serrations are duplicated through the same procedures.

Further, a depth code piece 59 which is used in the second embodiment is shown in FIG. 13, and this depth code piece 59 has contacting faces 60*a* through 60*d* each of which is provided with a width corresponding respectively to the depth code. And, by inserting this plate between the key-holding means 16 and the punch 14, die 11 or the supporting means thereof, the actual depth of groove to be cut by the punch 14 from the blank key 35 is selected.

In addition, because there are many kinds of pitch codes and depth codes depending on the kind of key, the plates satisfying those codes are prepared beforehand corresponding to the original keys so that any key corresponding to its original key code may be duplicated by selecting a proper code plate from those prepared beforehand.

What is claimed is:

1. A key duplicating machine for producing new original keys corresponding to key codes, comprising:

a frame having a base portion and a substantially C-shaped vertical member;

a manual pressing lever pivotally disposed at a top portion of said vertical member;

punch means including a guide member disposed vertically beneath said pressing lever and a die disposed therebelow;

key-holding means rotatably and slidably installed on a supporting shaft attached to said base portion by supporting arms such that said key-holding means on the supporting shaft is movable longitudinally with respect to said frame and is slidably movable on the shaft transversely with respect to said frame; and a pitch code plate having a plurality of spaced grooves therein at preset positions forming a code groove detecting portion corresponding to a key pitch code, said pitch code plate being removably mounted on said frame base portion with said grooves extending longitudinally with respect to said frame;

depth code plate means having a plurality of areas of different widths representing serration depths of a key, said depth code plate means being removably attached to said key-holding means and adjustably movable transversely thereon to selectively limit extent of longitudinal movement of said key-holding means by abutment with an element of said punch means; and means on said key holding means engagable with selected pitch code plate grooves, by rotating and sliding said key-holding means on said supporting shaft, to guide said key-holding means in longitudinal movement on said frame base portion so as to bring predetermined pitch portions of a key blank clamped in said key-holding means into cutting engagement with said punch means, wherein depth of said cutting engagement is determined by the limit of movement set by selected width areas of said depth code plate means, and wherein said manual pressing lever is operated to cut serrations of pitch and depth determined by said selected grooves of said pitch code plate and said depth code plate means width areas.

2. A key duplicating machine as recited in claim 1, wherein said pitch code plate has two ends and is formed with a hole at each end thereof, and said frame base portion is provided with pins engagable with said holes to retain said pitch code plate at a predetermined position thereon.

3. A key duplicating machine as recited in claim 1, wherein said depth code plate means is formed with an L-shaped cross section, and said key-holding means is formed with a corresponding L-shaped groove for retaining said plate means.

4. A key duplicating machine as recited in claim 1, wherein said depth code plate means has an edge formed in a stair-like shape to provide the areas of different widths.

* * * * *